US007931056B2

(12) United States Patent
Durant et al.

(10) Patent No.: US 7,931,056 B2
(45) Date of Patent: Apr. 26, 2011

(54) DEBARKING APPARATUS

(75) Inventors: Michael J. Durant, Vancouver (CA); C. Todd Macey, Port Coquitlam (CA); Robert M. McNicol, Mission (CA)

(73) Assignee: Carmanah Design & Manufacturing, Inc., Vancouver, British Columbia (CA)

( * ) Notice: Subject to any disclaimer, the term of this patent is extended or adjusted under 35 U.S.C. 154(b) by 20 days.

(21) Appl. No.: 12/262,136

(22) Filed: Oct. 30, 2008

(65) Prior Publication Data

US 2010/0108195 A1 May 6, 2010

(51) Int. Cl.
*B27L 1/00* (2006.01)

(52) U.S. Cl. ..... 144/208.9; 144/208.7

(58) Field of Classification Search ..... 144/208.1, 144/208.4, 208.7, 208.9, 208.8, 208.91
See application file for complete search history.

(56) References Cited

U.S. PATENT DOCUMENTS 3,324,909 A * 6/1967 McCranie ..... 144/375
3,976,271 A 8/1976 Larsson et al.
4,384,600 A 5/1983 Kivimaa
4,685,498 A 8/1987 Nakajima et al.
5,070,920 A 12/1991 Morey
5,168,907 A * 12/1992 Herrington et al. ..... 144/228
5,647,418 A 7/1997 Ishizawa
6,260,592 B1 7/2001 Lindholm
6,578,609 B1 * 6/2003 McNicol et al. ..... 144/208.9
6,615,884 B2 9/2003 Havumaki et al.

* cited by examiner

*Primary Examiner* — Shelley Self

(74) *Attorney, Agent, or Firm* — Fitzpatrick, Cella, Harper & Scinto

(57) ABSTRACT

A debarking apparatus includes a cutting body having a cutting surface and a first projection configured to cooperate with a fastener. The debarking apparatus also includes a holding body for removably holding the cutting body, the holding body having a trailing surface and defining a first recess generally complementary to the first projection to receive therein the first projection in a close surrounding fit, and a first opening sized to receive the fastener. The fastener is configurable to pass through the first opening and to cooperate with the first projection and with the holding body to hold the first projection in the first recess in a close surrounding fit.

11 Claims, 6 Drawing Sheets

DEBARKING APPARATUS

BACKGROUND OF THE INVENTION

1. Field of Invention

The invention relates generally to debarking, and more particularly to a debarking apparatus including a cutting body and a holding body for removably holding the cutting body.

2. Description of Related Art

Some types of debarking machines for removing bark from logs include a container for holding logs to be debarked, and also include one or more rotatable drums that protrude into the interior of the container. In these debarking machines, one or more debarking teeth may be mounted to an outer circumference of the rotatable drums, such that in operation, rotation of the rotatable drums may cause the debarking teeth to engage with logs that are in the container, to remove bark from the logs.

Prolonged use of these types of debarking machines may cause the debarking teeth to be abraded. Also, different configurations of the debarking teeth may be desirable for different applications. For example, more aggressive debarking teeth may be preferable in winter conditions when logs may be frozen, or for logs of harder wood species of trees. Therefore, it may be desirable for cutting teeth to include a detachable cutting portion that can be removed and replaced with a new, sharpened, or different cutting portion.

In one known arrangement, a debarking tooth includes a platform (which may also be referred to as a "shoe") and a blade tip plate (which may also be referred to as a "cutting block"). The blade tip plate in this arrangement includes a plurality of tooth portions, and defines three through holes through a top cutting surface of the blade tip plate. Bolts may pass through respective through holes in the blade tip plate and engage respective female screw portions in the platform, to attach the blade tip plate to the platform.

A debarking machine may include hundreds of blade tip plates, and removing and replacing blade tip plates in the aforementioned type of arrangement may be cumbersome and time-consuming. The biggest problem in the field is that the wear that the top surfaces of the blade tip plates encounter in normal debarking use also affects the bolts holding the plates in place. In some cases, the wear at the bolt head is severe enough that the bolt head is not deep enough to receive a wrench to engage and rotate the bolt. If this happens, it may be necessary to weld an extension onto the bolt to provide sufficient purchase for the wrench to loosen and remove the bolt.

As well, because the through openings for receiving the fasteners are on the top cutting surface of the blade tip plate, debris from debarking (such as wood, bark, or mud, for example) may become lodged in the through openings, potentially interfering with attempts to remove or replace the blade tip plates by impeding use of tools to remove the bolts. Furthermore, it has been found that in these types of arrangements, three bolts may be required to fix the blade tip plate securely to the platform, adding to the time and expense that may be involved in removing and replacing the blade tip plates.

SUMMARY OF THE INVENTION

Accordingly, the present invention provides a debarking apparatus comprising:

a cutting body having a cutting surface and a first abutting surface, the cutting body including a first projection projecting from the first abutting surface, the first projection being configured to cooperate with a fastener; and a holding body for removably holding the cutting body, the holding body having a leading surface, a trailing surface, and a second abutting surface, the holding body defining a first recess in the second abutting surface and defining a first opening extending between the first recess and the trailing surface, the second abutting surface being generally complementary to the first abutting surface for removable abutment with the first abutting surface, the first opening being sized to receive the fastener, and the first recess being generally complementary to the first projection to receive therein the first projection in a close surrounding fit when the first abutting surface abuts the second abutting surface;

wherein when the first abutting surface abuts the second abutting surface, the cutting surface is exposed for debarking and the fastener is configurable to pass through the first opening and to cooperate with the first projection and with the holding body to hold the first projection in the first recess in a close surrounding fit and to hold the first abutting surface against the second abutting surface.

In a further aspect, the present invention provides A debarking apparatus comprising:

a cutting body having a cutting surface and a first abutting surface, the cutting body including a first projection projecting from the first abutting surface, the first projection being configured to receive a fastener; and a holding body for removably holding the cutting body, the holding body having a leading surface, a trailing surface, and a second abutting surface, the holding body defining a first recess in the second abutting surface and defining a first opening extending between the first recess and the trailing surface, the second abutting surface being generally complementary to the first abutting surface for releasable abutment with the first abutting surface, and the first recess being generally complementary to the first projection to receive therein the first projection in a close surrounding fit when the first abutting surface abuts the second abutting surface;

wherein when the first abutting surface abuts the second abutting surface, the cutting surface is exposed for debarking and the fastener is extendable through the first opening in the trailing surface of the cutting body to engage the first projection to hold the cutting body against the holding body.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DESCRIPTION OF THE PREFERRED EMBODIMENTS

Figure 1:
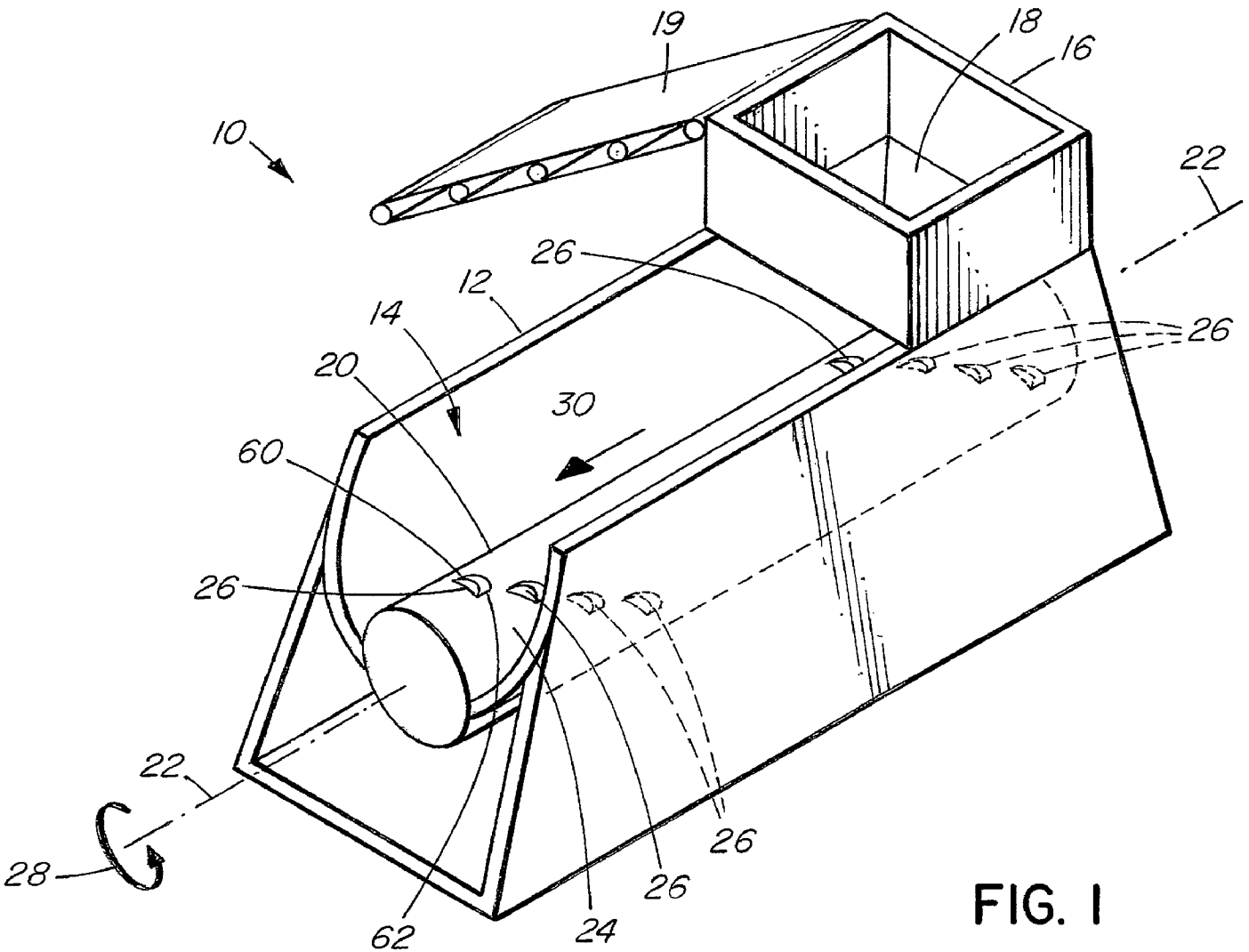
FIG. 1 is a perspective view of an exemplary debarking machine.

Referring to FIG. 1, an exemplary debarking machine is shown generally at 10. Debarking machine 10 includes a housing 12 that defines a debarking region shown generally at 14. Debarking machine 10 further includes a hopper 16 for organizing logs or other material to be debarked (not shown). Logs or other material may be supplied to hopper 16 using a conveyer mechanism 19, for example, for subsequent delivery by gravity into the debarking region 14 of housing 12.

Debarking machine 10 further includes a rotary debarker 20, which in the illustrated example is a generally cylindrical drum rotatable about an axis of rotation shown generally at 22. Often debarker 20 comprises two or more cylindrical drums rotatable within housing 12. Each drum of rotary debarker 20 has a generally cylindrical exterior surface 24, and at least one debarking apparatus 26 coupled to exterior surface 24. In the illustrated example, a plurality of debarking apparatuses 26 are coupled to exterior surface 24 in a generally helical arrangement. Therefore, in the illustrated example, when rotary debarker 20 is rotated in the direction indicated by arrow 28, logs or other material released from holder 16 through opening 18 will generally be urged longitudinally along debarking region 14 in a direction indicated by arrow 30. Further details regarding exemplary debarking machines may be found in U.S. Pat. No. 5,647,418 to Ishizawa, which is hereby incorporated by reference in its entirety herein.

Figure 2:
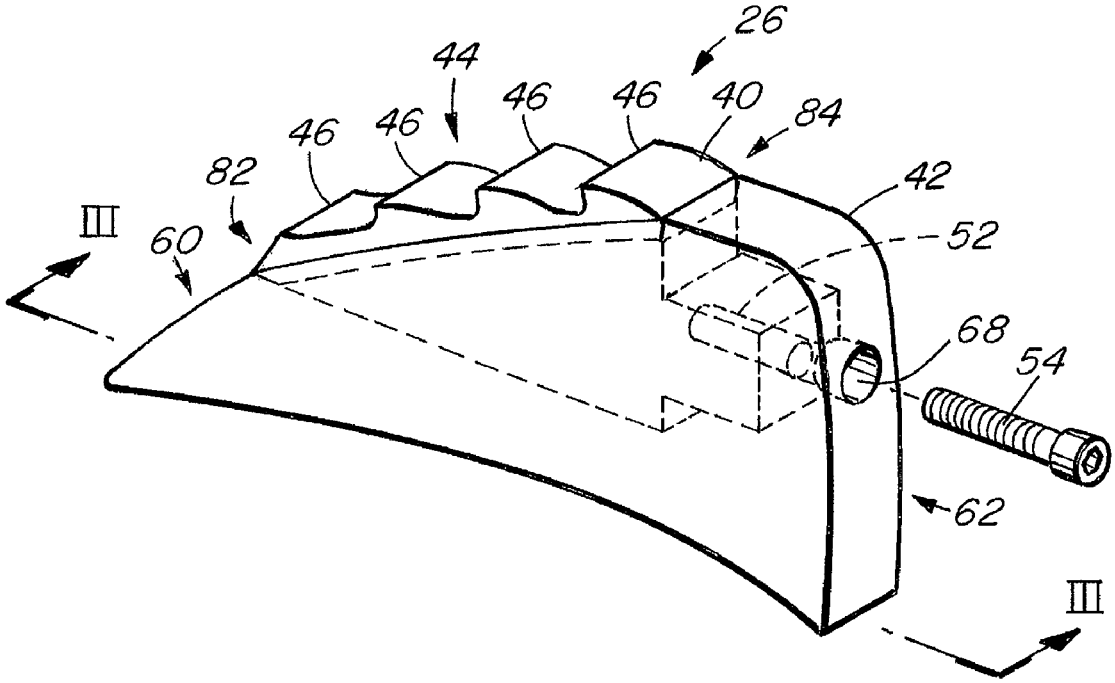
FIG. 2 is a partially exploded perspective view of a debarking apparatus shown in FIG. 1.
Figure 3:
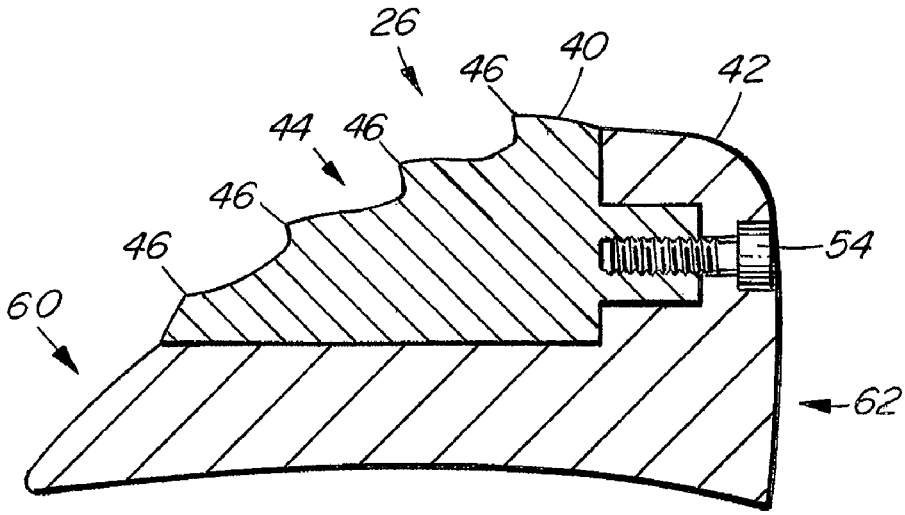
FIG. 3 is a cross section view of the debarking apparatus shown in FIG. 2, taken along line III shown in FIG. 2.

Referring to FIGS. 2 and 3, debarking apparatus 26 is shown in greater detail. Debarking apparatus 26 includes a cutting body 40 and a holding body 42 for removably holding the cutting body.

Figure 4:
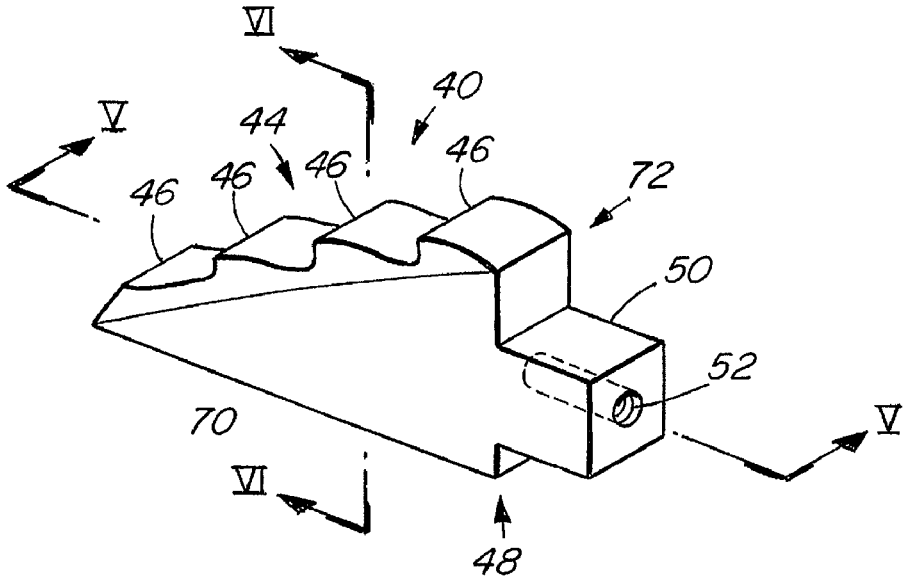
FIG. 4 is a perspective view of a cutting body shown in FIGS. 2 and 3.
Figure 5:
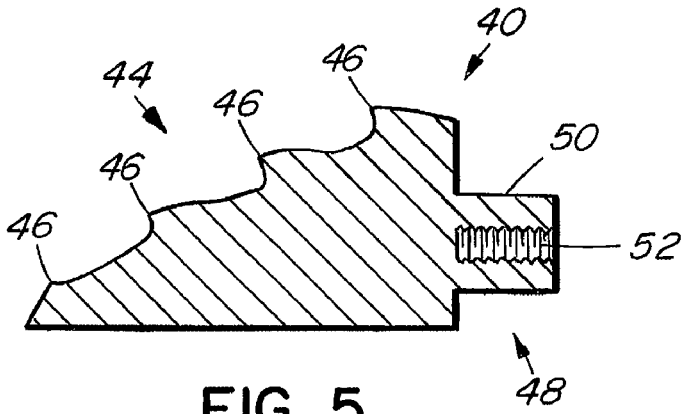
FIG. 5 is a cross sectional view of the cutting body shown in FIG. 4, taken along the line V shown in FIG. 4.
Figure 6:
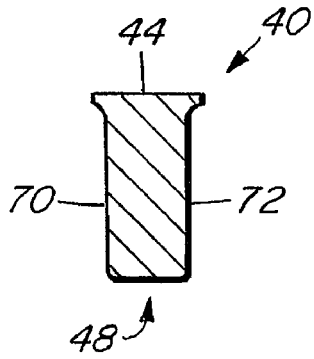
FIG. 6 is a cross sectional view of the cutting body shown in FIG. 4, taken along line VI shown in FIG. 4.

Referring to FIGS. 4, 5, and 6, cutting body 40 is shown in greater detail. Cutting body 40 has a cutting surface shown generally at 44, which preferably includes at least one or a plurality of cutting teeth 46. Cutting body 40 also has a first abutting surface shown generally at 48, and a first projection 50 projecting from first abutting surface 48. First projection 50 preferably includes a threaded bore 52 for receiving a fastener, such as a bolt 54 illustrated in FIGS. 2 and 3, for example. First projection 50 is thus configured to cooperate with a fastener such as hex bolt 54, although alternatively, projection 50 may be configured to cooperate with other types of fasteners. Cutting body 40 may be made from a conventional hardened material such as ASTM A732 10Q (also known as 4340 carbon steel), and may be hardened to a Rockwell hardness between Rc 53 and Rc 55, for example.

Figure 7:
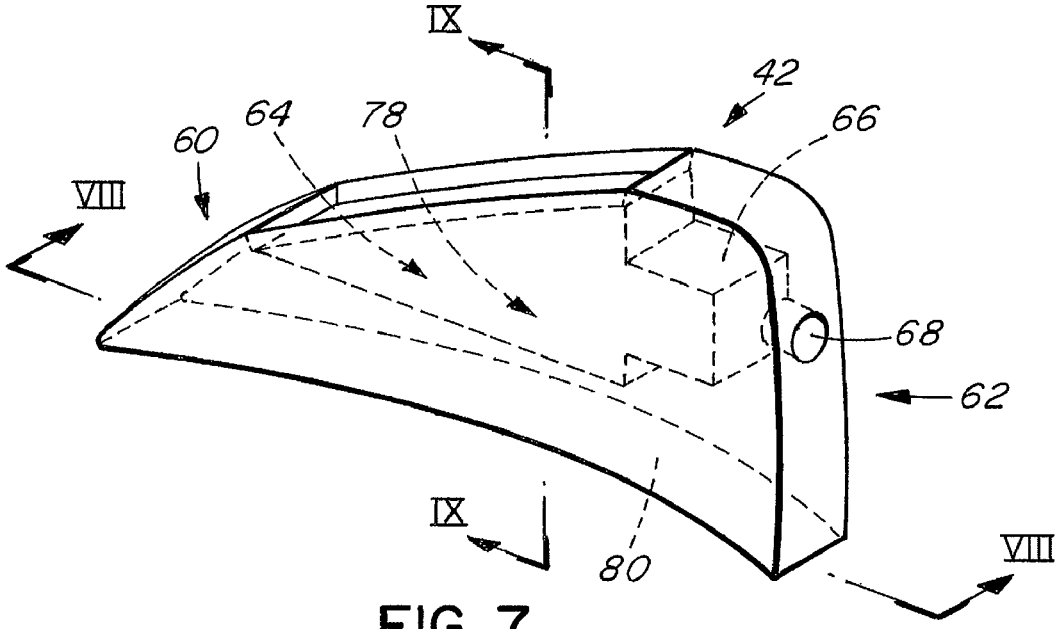
FIG. 7 is a perspective view of a holding body shown in FIGS. 2 and 3.
Figure 8:
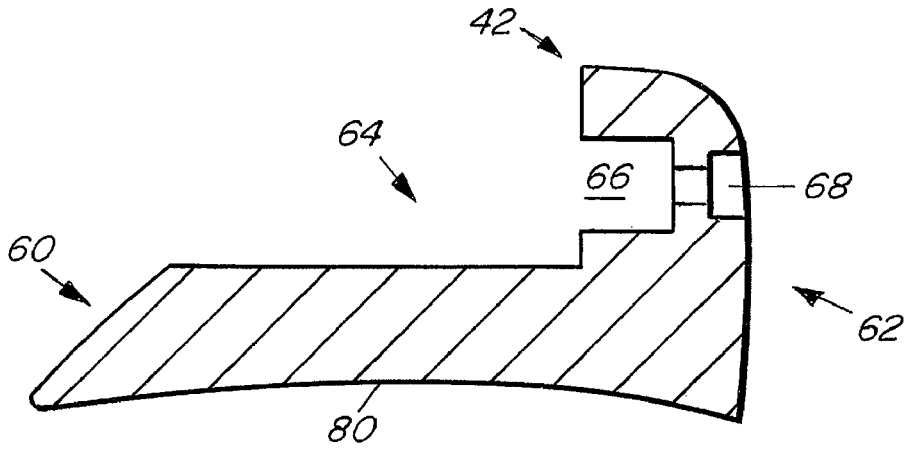
FIG. 8 is a cross sectional view of the holding body shown in FIG. 7, taken along the line VIII shown in FIG. 7.
Figure 9:
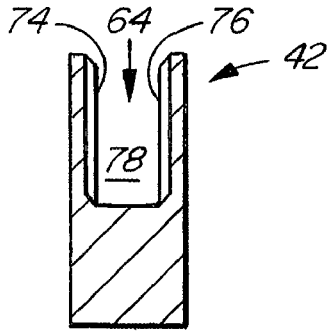
FIG. 9 is a cross sectional view of the holding body shown in FIG. 7, taken along the line IX shown in FIG. 7.

Referring to FIGS. 7, 8, and 9, holding body 42 is shown in greater detail. Holding body 42 has a leading surface shown generally at 60 and a trailing surface shown generally at 62. Referring back to FIG. 1, debarking apparatus 26 may be positioned on exterior surface 24 of rotary debarker 20 such that when rotary debarker 20 rotates in the direction shown by arrow 28, leading surface 60 is on a leading side of debarking apparatus 26 and trailing surface 62 is on a trailing side of debarking apparatus 26. However, leading surface 60 and trailing surface 62 are not dependent on the actual positioning of debarking apparatus 26 on a debarking drum, or on movement of a debarking drum.

Referring back to FIGS. 7, 8, and 9, holding body 42 also has a second abutting surface shown generally at 64, and second abutting surface 64 is generally complementary to first abutting surface 48 of the cutting body shown in FIGS. 4, 5, and 6, such that first abutting surface 48 may removably abut second abutting surface 64. Holding body 42 also defines a first recess 66 in second abutting surface 64, and first recess 66 is generally complementary to first projection 50 of the cutting body shown in FIGS. 4 and 5, such that first projection 50 may be received in first recess 66 in a close surrounding fit when first abutting surface 48 abuts second abutting surface 64, to hold cutting body 40 securely in holding body 42. Holding body 42 also defines a first opening 68 extending between first recess 66 and trailing surface 62, first opening 68 being sized to receive bolt 54 illustrated in FIGS. 2 and 3, for example, or to receive any fastener with which first projection 50 is configured to cooperate. Holding body 42 may be made from a material such as 1020 carbon steel, and may be made as a cast only so that no hardening is required.

Referring again to FIGS. 4 and 6, first abutting surface 48 preferably includes first and second opposite and spaced apart lateral surfaces 70 and 72 adjacent cutting surface 44, and referring to FIG. 9, second abutting surface 64 preferably includes third and fourth opposite and spaced apart lateral surfaces 74 and 76 generally complementary to first and second lateral surfaces 70 and 72, respectively. Second abutting surface 64 thus preferably defines a cavity 78 for receiving cutting body 40. Advantageously, lateral surfaces 70 and 72 may abut lateral surfaces 74 and 76, respectively, and may cooperate to prevent lateral movement of cutting body 40 relative to holding body 42 when first abutting surface 48 abuts second abutting surface 64. Referring to FIG. 2, preferably only cutting surface 44 of cutting body 40 is exposed when cutting body 40 is received in cavity 78.

Referring now to FIGS. 7 and 8, holding body 42 preferably also has a coupling surface 80 configured for mounting to a portion of exterior surface 24 of rotary debarker 20 as illustrated in FIG. 1. Coupling surface 80 preferably includes a concave portion generally complementary to the portion of exterior surface 24, such that debarking apparatus 26 is coupleable (by welding, for example) to the portion of exterior surface 24 with leading surface 60 and trailing surface 62 positioned as shown in FIG. 1.

Referring again to FIGS. 2 and 3, when first abutting surface 48 abuts second abutting surface 64, cutting body 40 and holding body 42 preferably form a debarking assembly generally having a wedge shape. In the preferable configuration illustrated in FIGS. 2 and 3, when first abutting surface 48 abuts second abutting surface 64, cutting surface 44 generally adjoins leading surface 60 and trailing surface 62 at adjoining points illustrated generally at 82 and 84 respectively. Thus, cutting body 40 and holding body 42, when in the configuration illustrated in FIGS. 2 and 3, preferably form a generally contiguous cutting shape for use in debarking machine 10 illustrated in FIG. 1. Cutting body 40 may be installed in holding body 42 by abutting first abutting surface 48 against second abutting surface 64. In this configuration, cutting surface 44 is exposed for debarking, and bolt 54 may be passed through first opening 68 and received in threaded bore 52 to cooperate with first projection 50 and with holding body 42 to hold first projection 50 in first recess 66 in a close surrounding fit, and to hold first abutting surface 48 against second abutting surface 64.

Advantageously, cutting surface 44 is preferably exposed in a region of debarking apparatus 26 that will impact logs for debarking the logs, when cutting apparatus 26 is installed and used in debarking machine 10 generally in the manner illustrated in FIG. 1. Therefore, wear from debarking over time will preferably be borne primarily on cutting surface 44. When cutting surface 44 has been worn to an undesirable extent, or when a cutting surface having a different configuration is desirable (for debarking logs of a different species of trees or for debarking in different environmental conditions, for example), cutting body 40 may be removed from holding body 42 by removing bolt 54 from threaded bore 52. A new, different, or sharpened cutting body, for example, may then be installed in holding body 42. Advantageously, because of the close surrounding fit of first projection 50 in first recess 66 and because of the various points of abutment of abutting surfaces 48 and 64, a single fastener, illustrated as bolt 54, may be sufficient to hold cutting body 40 in holding body 42, desirably simplifying installation and removal of cutting bodies from holding body 42 when compared to conventional three-bolt arrangements, for example. Furthermore, the positioning of bolt 54 through first opening 68 in trailing surface 62, as illustrated in FIGS. 2 and 3 may advantageously prevent debris (such as bark, wood, mud, or other debris) from interfering with installation of cutting body 40, in or removal of cutting body 40 from, holding body 42.

Figure 10:
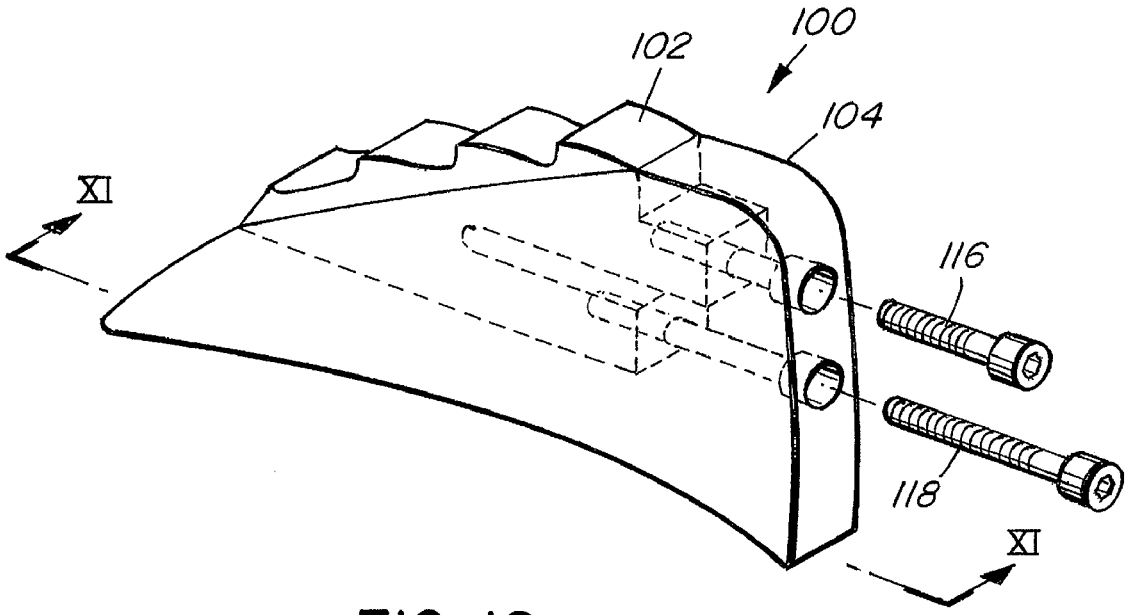
FIG. 10 is a perspective view of an alternative debarking apparatus.
Figure 11:
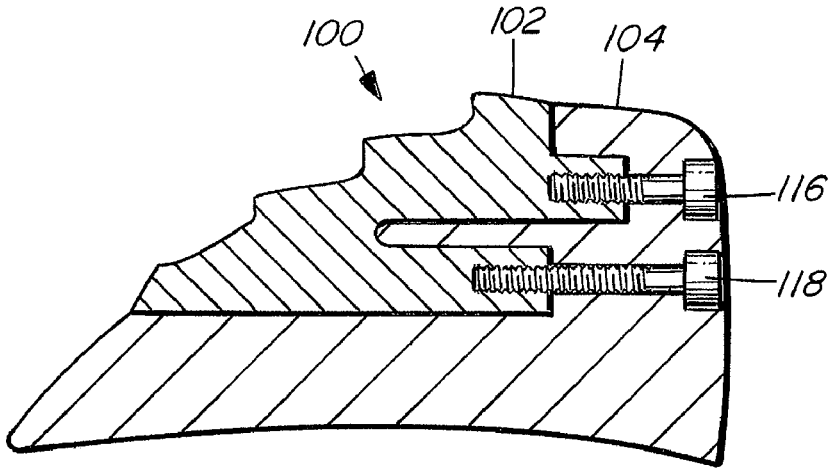
FIG. 11 is a cross sectional view of the debarking apparatus shown in FIG. 10, taken along the line XI shown in FIG. 10.

Referring to FIGS. 10 and 11, an alternative debarking apparatus is shown generally at 100. Debarking apparatus 100 includes a cutting body 102 and a holding body 104 for removably holding cutting body 102. Debarking apparatus 100, cutting body 102, and holding body 104 are generally similar to debarking apparatus 26, cutting body 40, and holding body 42 respectively. However, referring to FIG. 12, cutting body 102 has a first abutting surface 106, and first and second projections 108 and 110 projecting from first abutting surface 106. Projections 108 and 110 include respective threaded bores 112 and 114 for receiving first and second bolts 116 and 118, respectively, as illustrated in FIGS. 10 and 11. Projections 108 and 110 are thus configured to cooperate with bolts 116 and 118 respectively. Alternatively, projections 108 and 110 may be configured to cooperate with other types of respective fasteners.

Figure 12:
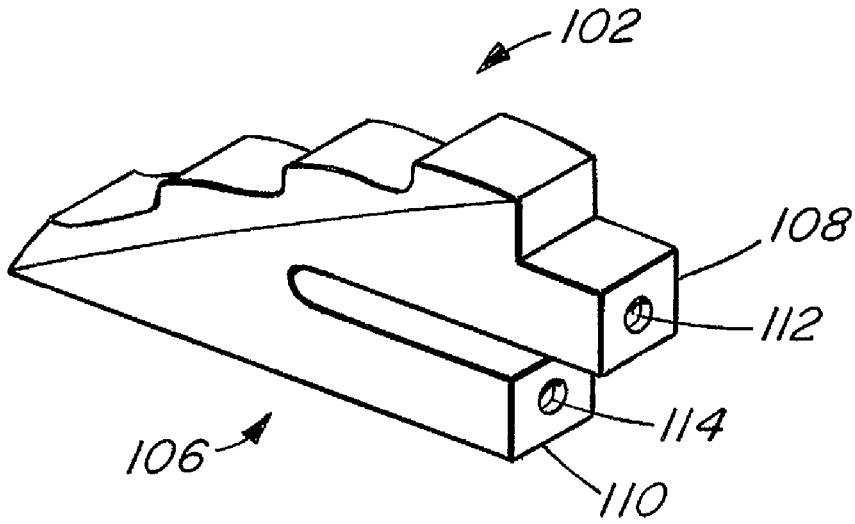
FIG. 12 is a perspective view of a cutting body shown in FIGS. 10 and 11.
Figure 13:
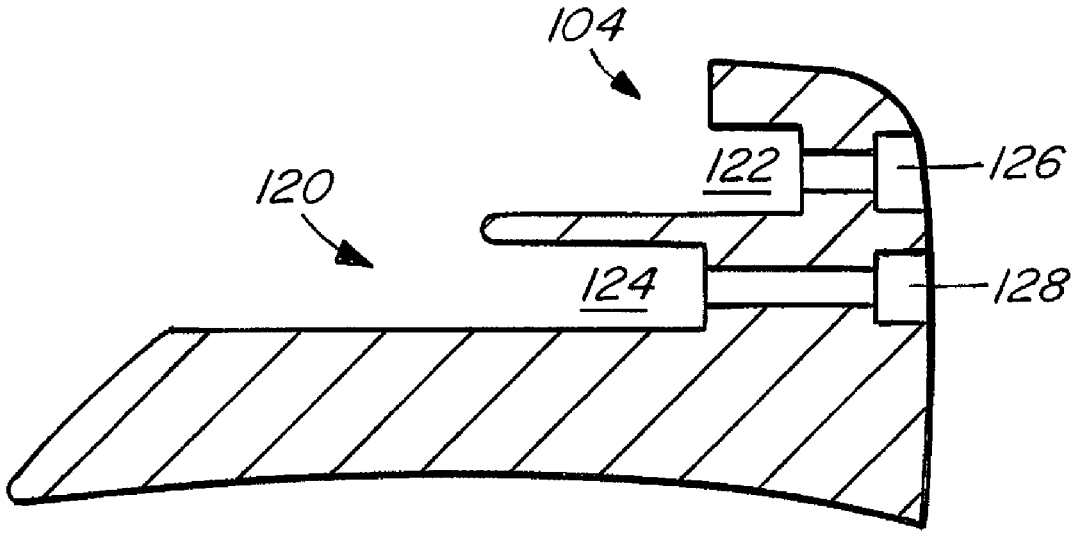
FIG. 13 is a cross sectional view of a holding body shown in FIGS. 10 and 11, taken along the line XIII shown in FIG. 10.

Referring to FIG. 13, holding body 104 includes a second abutting surface 120 generally complementary to first abutting surface 106 of the cutting body shown in FIG. 12, and holding body 104 defines first and second recesses 122 and 124 generally complementary to first and second protections 108 and 110, respectively, of the cutting body (shown in FIG. 12). First recess 122 receives first projection 108 in a close surrounding fit and second recess 124 receives second projection 110 in a close surrounding fit when first abutting surface 106 abuts second abutting surface 120. Still referring to FIG. 13, holding body 104 also defines first and second openings shown generally at 126 and 128, sized to receive first and second bolts 116 and 118 respectively, as illustrated in FIGS. 10 and 11, or any other fasteners with which projections 108 and 110 are configured to cooperate. Thus, cutting body 102 may be installed in holding body 104 using first and second bolts 116 and 118 to cooperate with first and second projections 108 and 110, and with holding body 104, to hold first projection 108 in first recess 122 in a close surrounding fit, to hold second projection 110 in second recess 124 in a close surrounding fit, and to hold first abutting surface 106 against second abutting surface 120.

Thus, in operation, debarking apparatus 100 may be installed on exterior surface 24 of rotary debarker 20 illustrated in FIG. 1, in a manner described above for debarking apparatus 26, for debarking logs or other material.

While specific embodiments of the invention have been described and illustrated, such embodiments should be considered illustrative of the invention only and not as limiting the invention as construed in accordance with the accompanying claims.

What is claimed is:

1. A debarking apparatus comprising:

a cutting body having a cutting surface and a first abutting surface, the cutting body including a first projection projecting from the first abutting surface, the first projection being configured to cooperate with a fastener; and a holding body for removably holding the cutting body, the holding body having a leading surface, a trailing surface, and a second abutting surface, the holding body defining a first recess in the second abutting surface and defining a first opening extending between the first recess and the trailing surface, the second abutting surface being generally complementary to the first abutting surface for removable abutment with the first abutting surface, the first opening being sized to receive the fastener, and the first recess being generally complementary to the first projection to receive therein the first projection in a close surrounding fit when the first abutting surface abuts the second abutting surface;

wherein when the first abutting surface abuts the second abutting surface, the cutting surface is exposed for debarking and the fastener is configurable to pass through the first opening and to cooperate with the first projection and with the holding body to hold the first projection in the first recess in a close surrounding fit and to hold the first abutting surface against the second abutting surface.

2. The debarking apparatus of claim 1 wherein the cutting surface comprises at least one cutting tooth.

3. The debarking apparatus of claim 1 wherein the cutting surface comprises a plurality of cutting teeth.

4. The debarking apparatus of claim 1 wherein when the first abutting surface abuts the second abutting surface, the cutting body and the holding body form a debarking assembly generally having a wedge shape.

5. The debarking apparatus of claim 1 wherein when the first abutting surface abuts the second abutting surface, the cutting surface generally adjoins the leading surface and the trailing surface.

6. The debarking apparatus of claim 1 wherein the first abutting surface includes first and second opposite and spaced apart lateral surfaces adjacent the cutting surface, and wherein the second abutting surface includes third and fourth opposite and spaced apart lateral surfaces generally complementary to the first and second lateral surfaces respectively.

7. The debarking apparatus of claim 1 wherein the second abutting surface defines a cavity for receiving the cutting body, and wherein only the cutting surface of the cutting body is exposed when the cutting body is received in the cavity.

8. The debarking apparatus of claim 1 wherein the holding body further has a coupling surface adapted to be couplable to a portion of an exterior surface of a rotary debarker.

9. The debarking apparatus of claim 8 wherein the coupling surface includes a concave portion adapted to be complementary to the portion of the exterior surface of the rotary debarker.

10. The debarking apparatus of claim 1:

wherein the cutting body further includes a second projection projecting from the first abutting surface and spaced apart from the first projection, the second projection being configured to cooperate with a second fastener;

wherein the holding body defines a second recess in the second abutting surface, the second recess being separated from the first recess and generally complementary to the second projection to receive therein the second projection in a close surrounding fit when the first abutting surface abuts the second abutting surface;

wherein the holding body defines a second opening extending between the second recess and the trailing surface, the second opening being sized to receive the second fastener; and wherein when the first abutting surface abuts the second abutting surface, the second fastener is configurable to pass through the second opening and to cooperate with the second projection and with the holding body to hold the second projection in the second recess in a close surrounding fit and to hold the first abutting surface against the second abutting surface.

11. A debarking apparatus comprising:

a cutting body having a cutting surface and a first abutting surface, the cutting body including a first projection projecting from the first abutting surface, the first projection being configured to receive a fastener; and a holding body for removably holding the cutting body, the holding body having a leading surface, a trailing surface, and a second abutting surface, the holding body defining a first recess in the second abutting surface and defining a first opening extending between the first recess and the trailing surface, the second abutting surface being generally complementary to the first abutting surface for releasable abutment with the first abutting surface, and the first recess being generally complementary to the first projection to receive therein the first projection in a close surrounding fit when the first abutting surface abuts the second abutting surface;

wherein when the first abutting surface abuts the second abutting surface, the cutting surface is exposed for debarking and the fastener is extendable through the first opening in the trailing surface of the holding body to engage the first projection to hold the holding body against the holding body.

* * * * *